United States Patent [19]

Goransson

[11] 4,022,543

[45] May 10, 1977

[54] APPARATUS FOR FACILITATING REMOVAL OF A MARINE PROPELLER BLADE

[75] Inventor: Stig Kåre Göransson, Kristinehamn, Sweden

[73] Assignee: Aktiebolaget Karlstads Mekaniska Werkstad, Karlstad, Sweden

[22] Filed: Oct. 21, 1975

[21] Appl. No.: 624,392

[52] U.S. Cl. ..... 416/146 R; 416/207; 415/129

[51] Int. Cl.[2] ..... B63H 5/14

[58] Field of Search ..... 415/129, 201, DIG. 3; 416/146, 207, 208; 403/3, 12, 15, 16

[56] References Cited

UNITED STATES PATENTS

| | | | |
|---|---|---|---|
| 2,291,014 | 7/1942 | Woody | 403/13 |
| 2,470,517 | 5/1949 | Obrist | 416/207 |
| 2,849,960 | 9/1958 | Olmstead et al. | 415/201 X |
| 2,916,095 | 12/1959 | Mades | 416/146 |
| 2,945,960 | 7/1960 | Obrist | 415/201 X |
| 3,063,743 | 11/1962 | Kylen | 416/146 X |
| 3,176,960 | 4/1965 | Sproule | 415/129 |
| 3,386,155 | 6/1968 | Jenkinson | 415/201 X |
| 3,557,744 | 1/1971 | Herbert | 416/146 X |
| 3,711,220 | 1/1973 | Ramback et al. | 416/146 |

FOREIGN PATENTS OR APPLICATIONS

| | | | |
|---|---|---|---|
| 1,141,144 | 8/1957 | France | 415/201 |
| 332,579 | 2/1971 | Sweden | 415/201 |
| 484,338 | 5/1938 | United Kingdom | 416/146 |
| 242,697 | 4/1971 | U.S.S.R. | 416/146 |

*Primary Examiner*—Everette A. Powell, Jr.
*Attorney, Agent, or Firm*—Brumbaugh, Graves, Donohue & Raymond

[57] ABSTRACT

Apparatus for facilitating dismounting and remounting a removable blade of a shrouded marine propeller comprises detachable brackets that are temporarily affixed to the propeller hub and the blade to be removed and a pivot pin that is installed through aligned holes in the brackets and forms a pivot axis about which the blade is flipped back out of the shroud, the blade having previously been positioned to reside generally in a plane including the propeller hub axis.

4 Claims, 6 Drawing Figures

APPARATUS FOR FACILITATING REMOVAL OF A MARINE PROPELLER BLADE

BACKGROUND OF THE INVENTION

It is known to provide an annular nozzle or shroud around a marine propeller in order to improve the propeller efficiency. Such a nozzle may be immovably fixed to the hull of a marine vessel (see, for example, Swedish Pat. No. 98.659 or it may be pivotally connected to the hull by means of a rudder stock (see, for example, Swedish Pat. No. 137.658), whereby the nozzle also acts as a steering device. It has been found that the clearance between the propeller blade tips and the nozzle should be as small as possible to obtain the highest possible propeller efficiency and the greatest thrust from the propeller-nozzle combination.

In shrouded marine propellers having removable (i.e., detachable) blades, for example, a built-up propeller or a variable pitch propeller, it is desirable to construct the propeller and shroud in such a way that the propeller blades can be installed or removed, such as for changing the blades, without dismouting the propeller or parts of the nozzle. Such propellers are usually made so that when a propeller blade has to be replaced it must first be moved a distance radially outward from the propeller hub toward the inner wall of the nozzle. This is particularly so in cases where the propeller blade flanges, by which the propeller blades are connected to the propeller hub, have guide edges and guide pins, the flanges being recessed in propeller blade sites formed on the propeller hub. Thus, for marine vessels having immovable nozzles, the clearance between the propeller blade tips and the inner wall of the nozzle must be at least equal to the radial distance necessary for removing the propeller blades.

To provide the smallest possible clearance between the propeller blade tips and the nozzle without dismantling or moving any part of the nozzle, most of the known solutions have concentrated on reducing the radial distance necessary for removing the propeller blades. This has been accomplished by making the guide edges and guide pins between the propeller hub and the propeller blade flanges as small as possible or by providing the blade flanges and the hub with spherical portions so that the blade flanges do not have to be recessed into the hub.

Although the known solutions succeed in minimizing the necessary clearance between the propeller blade tips and the nozzle, they jeopardize the safe attachment and sealing of the propeller blades and the propeller hub. Furthermore, where the clearance between the propeller blade tips and the nozzle is minimized, there are difficulties in transporting the propeller blade in and out of the nozzle.

Although pivotable nozzles may facilitate the replacement of the propeller blades by permitting the nozzle to be pivoted about its rudder stock so that the propeller hub can be turned to a position in which the propeller blade to be replaced is horizontal, positioning the propeller blade in a horizontal orientation creates several disadvantages. For example, in controllable pitch propellers the hub must be emptied of oil before the propeller blade can be moved to a horizontal position. Also, it is considerably more difficult to remove a large or heavy propeller blade when it is in a horizontal position, as opposed to a vertical position.

SUMMARY OF THE INVENTION

There is provided, in accordance with the present invention, an improved propeller for marine vessels which facilitates replacement of propeller blades while simultaneously maintaining a minimum clearance between the propeller blades and the inner wall of a surrounding nozzle, thereby eliminating possible damage to the propeller blades or nozzle and eliminating recesses on the inner surface of the nozzle which may disadvantageously affect the water flow therethrough.

More particularly, the improvement involves detachably mounted propeller blades which may be pivoted out of the nozzle. The propeller includes a rotatable propeller hub, recesses circumferentially spaced about the propeller hub to define propeller blade sites, and propeller blades having flanges attached to the root portion of each blade and removably and rotatably mounted in corresponding recesses. The blade flanges and the hub recesses have interfitting guide edges for properly locating the blades on the hub. The blade flanges and the recesses are formed to permit the blades to be rotated from an operating position generally in a plane more nearly perpendicular to the axis of rotation of the propeller hub to a non-operating position generally in a plane more nearly parallel to the axis of rotation of the propeller hub.

Each blade is provided with a hydraulic jack for displacing the blades away from the hub to disengage the guide edges. For example, the hydraulic jack may include a cylinder formed in the blade flanges and opening toward the hub recesses and a piston mounted in the cylinder for reciprocating movement generally radially relative to the axis of rotation of the propeller hub.

A first bracket adapted to be connected temporarily to the blade flanges and a second bracket adapted to be connected temporarily to the propeller hub are utilized for pivoting the blades out of the nozzle. The brackets are provided with holes which are aligned when a blade is in the non-operating position and the corresponding guide edges are disengaged. A pivot pin removably received through the holes when the holes are aligned permits the blades to be pivoted out of the nozzle about the pivot pin.

In one embodiment of the invention, the first bracket includes a pair of spaced-apart knuckles having aligned holes therethrough and the second bracket includes a knuckle that mates with the knuckles on the first bracket and has a hole therethrough. When the second bracket is mounted adjacent an aft portion of the blade flanges, the blades may be pivoted out of the nozzle in an arc defining a plane substantially including the axis of rotation of the propeller hub.

DESCRIPTION OF AN EXEMPLARY EMBODIMENT

Figure 1:
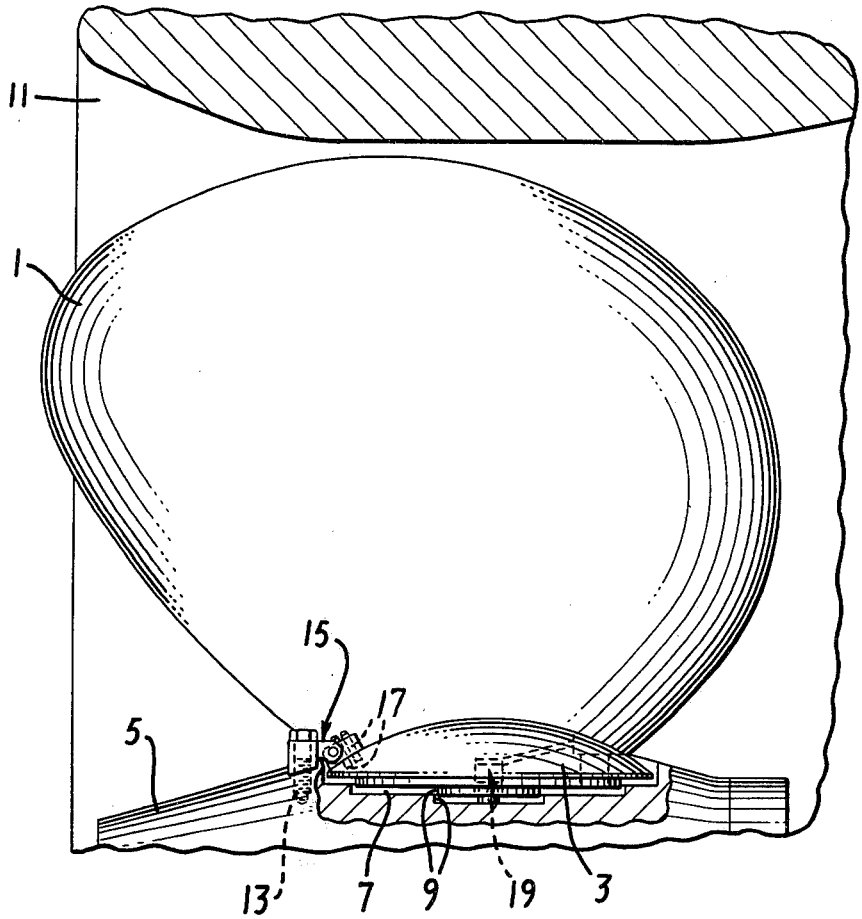
FIG. 1 is an elevational view of one embodiment of a propeller and nozzle constructed in accordance with the present invention, portions being broken away in section.

FIG. 1 shows a marine propeller including a propeller blade 1 having a circular blade flange 3 attached to or formed integrally with the root portion of the blade 1, each blade flange 3 being rotatably and releasably mounted in a recess 7 on a propeller hub 5. The blade flange 3 and the hub recess 7 are provided with interfitting guide edges 9 which assist in locating and retaining the propeller blade 1 in position on the propeller hub 5. An annular nozzle 11 surrounds the propeller.

Figure 2:
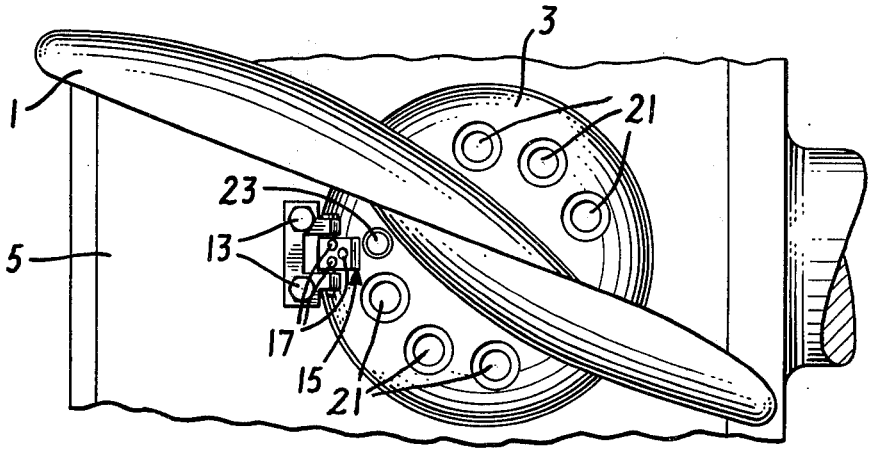
FIG. 2 shows the propeller of FIG. 1 from above, the nozzle being removed.

Two threaded holes 13 for attachment of one member of a bracket device 15 are arranged in the propeller hub 5 adjacent an aft portion of the recess 7 (see also FIG. 2). Three threaded holes 17 are arranged along the periphery of the blade flange 3 (see also FIGS. 2 and 3) for attachment of another member of the bracket device 15. The holes 17 are located so that when the propeller blade 1 has been turned to its most suitable mounting or dismantling position (as shown in FIGS. 1 and 2), usually about 90° from the design pitch position, i.e., the normal operating position, the holes 17 will be positioned between the holes 13 in the propeller hub 5. The blade flange 3 is also provided with a centrally located hydraulic jack 19 and a plurality of holes 21 for propeller blade bolts (not shonw) and a hole 23 for a guide pin (not shown).

Figure 3:
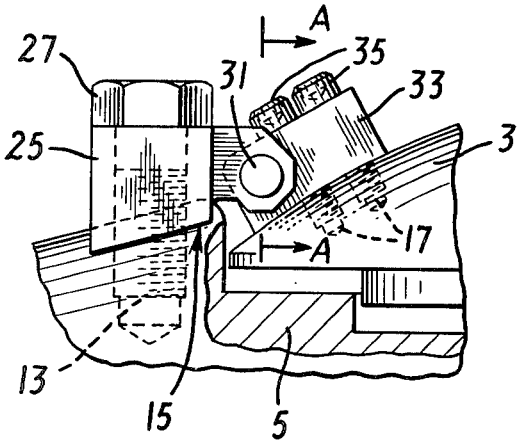
FIG. 3 shows, in an enlarged scale compared to FIG. 1, a pair of brackets which is attached to a blade flange and a propeller hub.
Figure 5:
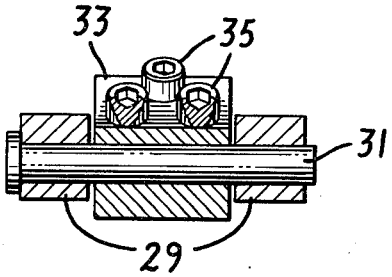
FIG. 5 shows a cross-sectional view taken along the line A—A in FIG. 3 and looking in the direction of the arrows.
Figure 4:
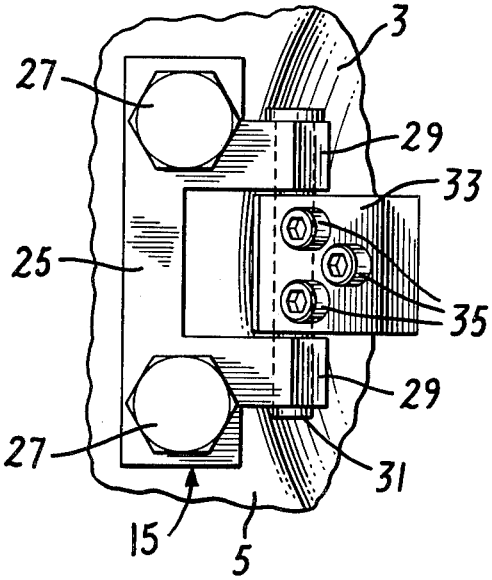
FIG. 4 shows the brackets of FIG. 3 from above.

FIGS. 3, 4 and 5 show the bracket device 15 including a first bracket 25 with a pair of spaced-apart knucles 29, the first bracket 25 being attached to the propeller hub 5 by screws 27 received in the threaded holes 13, and a second bracket 33 with a single knuckle, the second bracket 33 being attached to the blade flange 3 by screws 35 received in the holes 17. When coaxially aligned, the spaced-apart knuckles 29 of the first bracket 25 and the knuckle of the second bracket 33 are pivotally connected to each other by a pivot pin 31 which is removably received through holes in the knuckles of the brackets 25 and 33.

Figure 6:
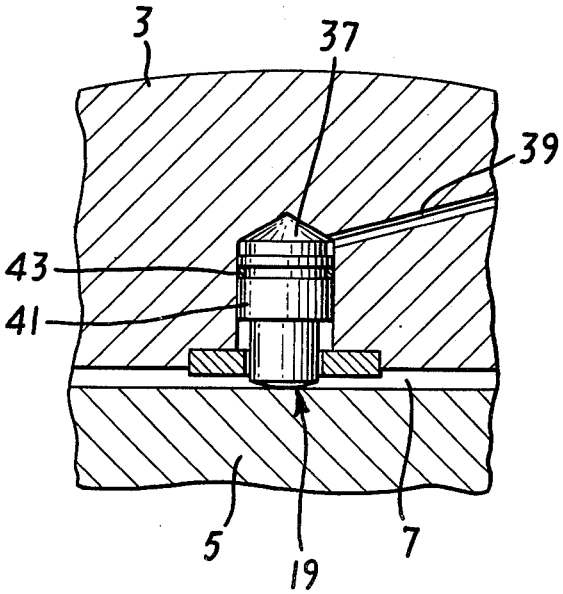
FIG. 6 shows, in an enlarged scale compared to FIG. 1, portions of the blade flange and the propeller hub and their relationship with a hydraulic jack.

FIG. 6 shows the hydraulic jack 19 including a cylinder 37, connectable by a conduit 39 to a pressurized source of hydraulic fluid (not shown), arranged centrally in the blade flange 3. A piston 41 with a piston ring 43 is slidably arranged in the hydraulic cylinder 37 for reciprocating movement relative to the axis of rotation of the propeller hub 5.

When the propeller blade 1 is to be removed, the propeller is turned such that the hub recess 7 is vertically oriented. The propeller blade 1 is then loosened from the hub recess 7 by removing the propeller blade bolts and the guide pin from the holes 21 and 23, respectively. The conduit 39 is connected to a pressurized source of hydrualic fluid and hydraulic fluid is conveyed to the hydrualic cylinder 37 moving the piston 41 downward and pressing it against the center of the hub recess 7, thus reducing the frictional resistance between the blade flange 3 and the hub recess 7. The propeller blade 1 is then rotated approximately $\pi°$ from its design pitch position so that the threaded holes 17 in the blade flange 3 will be positioned between the holes 13 in the propeller hub 5.

After the bracket 25 is fixed to the propeller hub 5 by screws 27 in the holes 13, the knuckle of the bracket 33 is aligned between the knuckles 29 of the bracket 25 and the bracket 33 is fixed to the blade flange 3 by the screws 35 in the holes 17. The propeller blade 1 is then lifted by the piston 41 in the hydraulic cylinder 37 such a distance that the guide edges 9 on the blade flange 3 and the hub recess 7 are disengaged from each other so that the pivot pin 31 can be inserted through the holes in the knuckles 29 of the bracket 25 and the knuckle of the bracket 33. The propeller blade 1 is thereafter pivoted about the pivot pin 31 to a generally horizontal position and, after the pivot pin 31 has been removed, moved out of the nozzle 11 in a horizontal direction.

When the propeller blade 1 is to be mounted, the bracket 25 is fixed to the propeller hub 5 and the bracket 33 is fixed to the blade flange 3. After the propeller blade 1 is moved horizontally into the nozzle 11, the knuckle of the bracket 33 is positioned between the knuckles 29 of the bracket 25 and the pivot pin 31 is inseted through the holes in the knuckles 29 of the bracket 25 and the knuckle of the bracket 33. The propeller blade 1 is thereafter pivoted about the pivot pin 31 to a vertical postion. After the removal of the brackets 25 and 33, the propeller blade 1 is turned to its design pitch-position, lowered, and attached by the blade bolts to the hub recess 7.

I claim:

1. In a marine propeller of the type that is surrounded by an annular nozzle and having a propeller hub with recesses circumferentially spaced thereabout and defining propeller blade sites, propeller blades having blade flanges removably and rotatably mounted in the recesses, the blade flanges and hub recesses having interfitting guide edges for properly locating the blades on the hub, the blades being rotatable from an operating position generally in a plane more nearly perpendicular to the axis of rotation of the propeller hub to a non- operating position generally in a plane more nearly parallel to the axis of rotation of the propeller hub, and hydraulic means for displacing the blades away from the hub to disengage the guide edges, the improvement comprising a first bracket adapted to be connected temporarily to the blade flanges and a second bracket adapted to be connected temporarily to the propeller hub, the brackets having holes which are aligned generally transversely of the rotational axis of the hub when a blade is in the non-operating position and the corresponding guide edges are disengaged, and a pivot pin removably received through the holes when the holes are aligned, so that the blade is pivotable about the pivot pin and out of the surrounding nozzle generally in the axial direction.

2. A propeller according to claim 1, wherein the first bracket includes a pair of spaced-apart knuckles having aligned holes therethrough and the second bracket includes a mating knuckle received between the knuckles of the first bracket and having a hole therethrough.

3. A propeller according to claim 1, wherein the hydraulic means includes a cylinder in the blade flanges and opening toward the hub recesses and a piston mounted in the cylinder for reciprocating movement generally radially relative to the axis of rotation of the propeller hub.

4. A propeller according to claim 1, wherein the second bracket is mounted adjacent an aft portion of the blade flanges so that the blades may be pivoted out of the nozzle in an arc defining a plane substantially including the axis of rotation of the propeller hub.

* * * * *